United States Patent [19]

Nakai et al.

[11] Patent Number: 5,009,288

[45] Date of Patent: Apr. 23, 1991

[54] SHEAVE ARRAY ARRANGEMENT FOR ELEVATOR

[75] Inventors: Keiichiro Nakai, Tokyo; Yoshinori Nakanishi, Shibayama, both of Japan

[73] Assignee: Otis Elevator Company, Farmington, Conn.

[21] Appl. No.: 436,269

[22] Filed: Nov. 14, 1989

[30] Foreign Application Priority Data

Dec. 9, 1988 [JP] Japan ..... 63-311541

[51] Int. Cl.[5] ..... B66B 11/04

[52] U.S. Cl. ..... 187/20; 187/94; 254/394

[58] Field of Search ..... 187/20, 23, 94, 95, 187/1 R, 1 A; 254/393, 394, 395, 397

[56] References Cited

U.S. PATENT DOCUMENTS

| | | | |
|---|---|---|---|
| 1,925 | 4/1875 | Newton | 187/20 |
| 146,699 | 1/1874 | Moore | 187/94 |
| 635,454 | 10/1899 | Wheaton | 187/23 |
| 3,845,842 | 11/1974 | Johnson | 187/94 |

*Primary Examiner*—Robert P. Olszewski
*Assistant Examiner*—Kenneth Noland
*Attorney, Agent, or Firm*—William W. Jones

[57] ABSTRACT

The suspension system for an elevator car provides ropes that converge on the car close to a vertical line containing the center of gravity of the car. The ropes thus impart very little lateral or torsional movement to the car whereby a smoother ride results. The ropes are mounted on a set of sheaves which are arranged in a V-shaped array. The ropes thus fed to the counterweight are spread farther apart than those fed from the sheaves to the car.

3 Claims, 2 Drawing Sheets

SHEAVE ARRAY ARRANGEMENT FOR ELEVATOR

DESCRIPTION

1. Technical Field

The present invention relates to an elevator sheave array arrangement disposed in the upper section of a building.

2. Background Art

In a conventional traction-type elevator, ropes for suspending a car and a counterweight for the elevator are mounted, on a sheave which is relatively wide such as, for example, substantially one half of the width of the car. The sheave or sheaves are arranged in parallel and/or coaxial. In particular, in an elevator using a linear motor, sheaves are disposed in a machine room in the upper section of a building, and the sheaves are disposed in a parallel coaxial array arrangement.

In the conventional parallel sheave array arrangement for an elevator, the car is suspended by a plurality of ropes at positions which are relatively far away from the vertical line passing through the center of gravity of the car, and therefore, due to deflections of the ropes and differences in tensions of the ropes therebetween caused by dispersion in pay-out speed of the ropes, extra moments are produced around the car, causing damage of guide rollers provided on both sides of the car, and feelings of uncomfortable oscillation given to the passengers.

DISCLOSURE OF THE INVENTION

In the present invention, there is provided a sheave array arrangement for an elevator, which is arranged in the upper section of a building and is adapted to suspend a car and a counterweight of the elevator, and the sheaves are arranged so that a plurality of ropes paid out from a sheave section for suspending the car to the car converge in the vicinity of a vertical line passing through the center of gravity of the car.

In the present invention, the sheave array arrangement for the elevator is disposed in the upper section of a building and is adapted to suspend a car and a counterweight of the elevator, with the maximum horizontal distance between ropes paid out to the car from a sheave section being reduced so as to be less that the maximum horizontal distance between ropes paid out from the sheave section to the counterweight. The ropes from the sheave for suspending the car converge in the vicinity of a vertical line passing through the center of gravity of the car, whereby a V-type array arrangement is formed.

It is preferable to constitute each of the sheaves suspending the car or the counterweight, with the use of a pair of sheaves for each rope.

With the sheave array arrangement as mentioned above, the ropes fixed to the car can be converged in the vicinity of the vertical line passing through the center of the gravity of the car, and therefore the car can be lifted and lowered with no extra moments being produced around the center of gravity of the car.

A first object of the present invention is to provide a sheave array arrangement for an elevator which can hold a constant attitude of an elevator car during movement of the car, that is, ascending and descending movement of the car.

A second object of the present invention is to provide a sheave array arrangement for an elevator, which can reduce the installation space of sheaves.

These and other objects and advantages of this invention will become more readily apparent from the following detailed description of a preferred embodiment thereof when taken in conjunction with the accompanying drawings, in which:

BEST MODE FOR CARRYING OUT THE INVENTION

Figure 1:
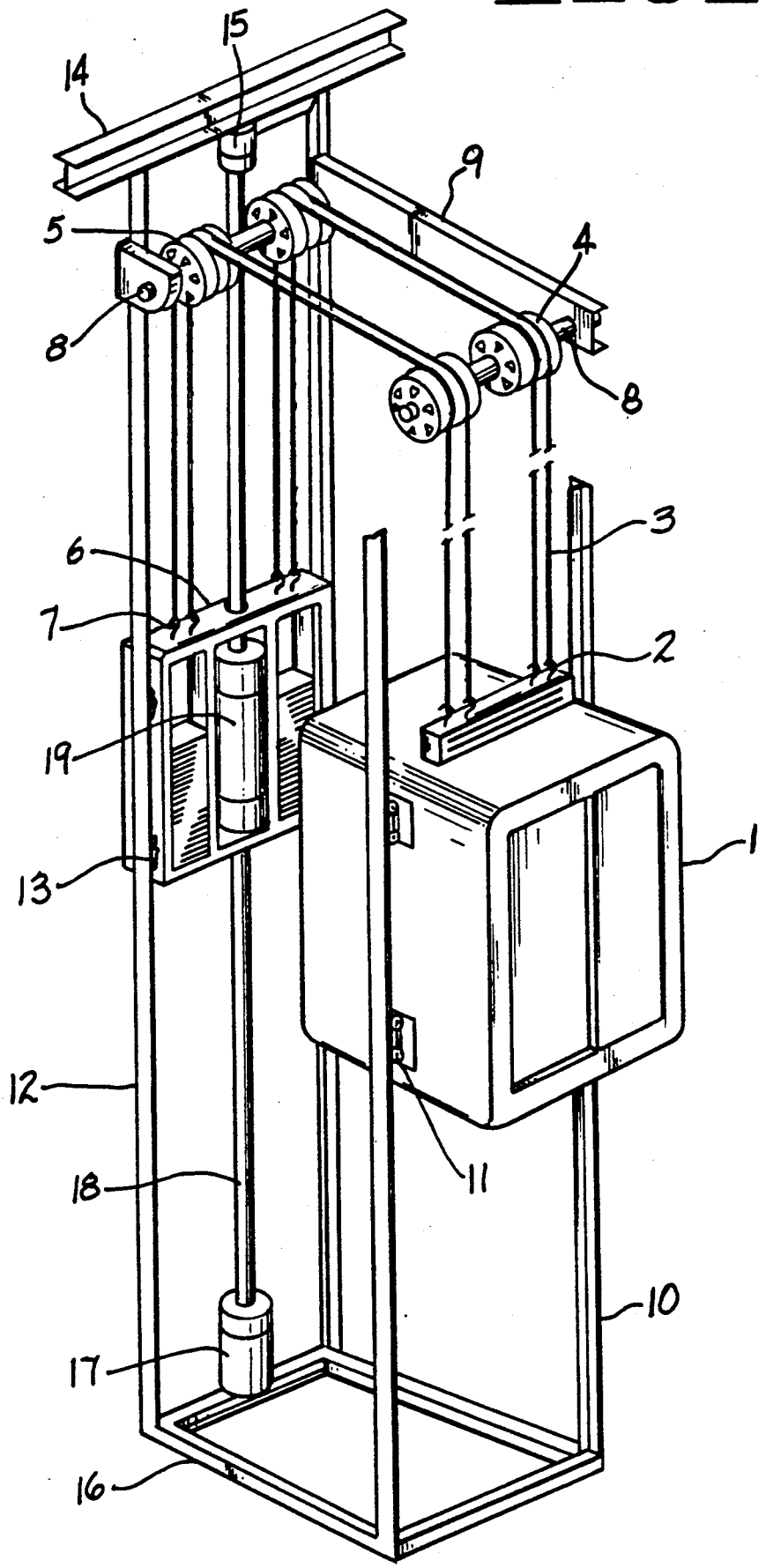
FIG. 1 is a schematic perspective view illustrating an elevator using a linear motor.

Referring to FIG. 1 which is a schematic perspective view illustrating an elevator using a linear motor, an elevator car 1 is fixed to one end of ropes 3 by means of rope fixing ends 2. The other ends of the ropes 3 are fixed to rope fixing ends 7 which are secured to the upper end of a counterweight 6, by way of first and second sheaves 4, 5 which are rotatably supported in the upper section of a building. The first sheave 4 and the second sheave 5 are supported on a sheave shaft support member 9 through the intermediary of a sheave shaft 8. The car 1 has car guide rollers 11 provided on both sides thereof and engaged with car guide rails 10. Meanwhile, the counterweight 6 has counterweight guide rollers 13 engaged with counterweight guide rails 12. The counterweight 6 is arranged such that it performs rectilinear motion in the vertical direction along a column 8 corresponding to the secondary conductor of a linear induction motor, which column 8 is supported at both ends by an upper end support section 15 secured to a ceiling beam 14 and a lower end support section 17 secured to a floor frame 16. Reference numeral 19 denotes the primary conductor of the linear motor. In the case of the linear induction motor shown in this embodiment, it is of such a type that the conductor 8 is held at the installation position, and the conductor 19 alone performs rectilinear motion. In FIG. 1, the conductor 19 is positioned in the center part of the counterweight 6 in consideration of the balance of the counterweight 6. The conventional sheaves have a parallel array arrangement having a relatively wide interval, as mentioned above.

Figure 2:
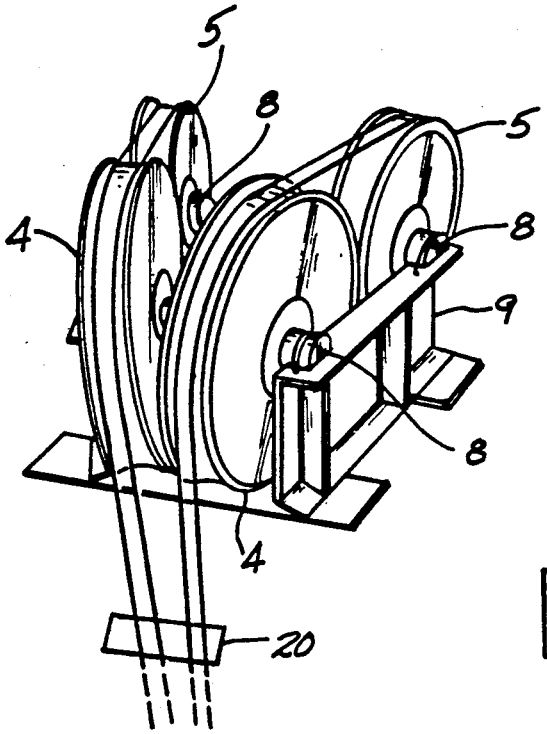
FIG. 2 is a schematic perspective view illustrating a sheave installation of a sheave array arrangement according to the present invention.
Figure 2:
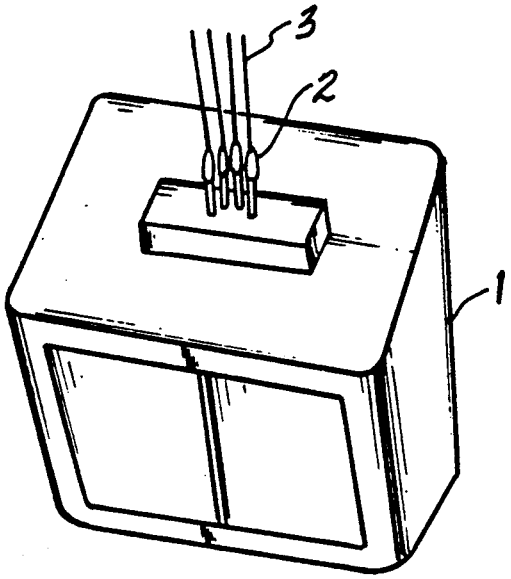

Referring to FIG. 2, which is a schematic perspective view illustrating the sheave installation for a sheave array arrangement according to the present invention, or a V-type sheave arrangement in particular, the ropes 3 are paid out from the sheaves in the upper section of the building and are fixed to the rope fixing ends 2 on the car 1. As clearly shown in FIG. 2, the rope fixing ends 2 fixing the ropes to the car are concentrated in the vicinity of the vertical line passing through the center of gravity of the car.

Figure 3:
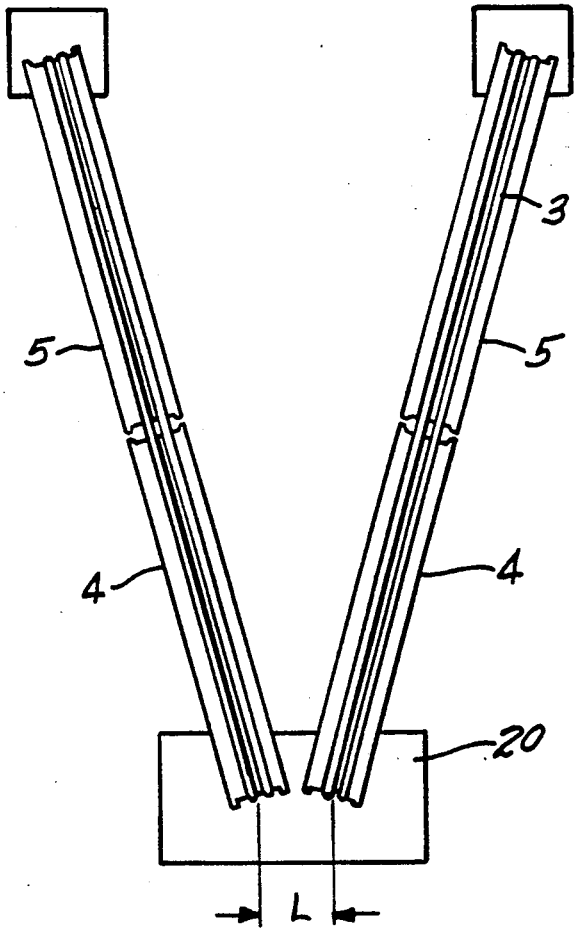
FIG. 3 is a top plan view illustrating the sheaves shown in FIG. 2.

FIG. 3 is a plan view illustrating the sheaves arranged in a V-shape as shown in FIG. 2. With this V-shape arrangement, a plurality of car side ropes can be brought to be close together For example, in the case of the sheaves in the V-type array arrangement in the present embodiment, the minimum space distance L between the centers of the adjacent sheaves as shown in FIG. 3 is set to be 100 mm, and by contrast, the maximum space distance between the centers of the counterweight side sheaves is set to 650 mm. From these numerical values, it is understandable that the sheave array arrangement according to the present invention effectively allows a plurality of ropes to approach the vertical line passing through the center of gravity of the car 1.

Since the present invention is arranged as described above, there can be offered the following advantages. Since a plurality of ropes are fixed to the car in the elevator and converge on the car in the vicinity of the vertical line passing through the center of gravity of the car, a constant attitude of the car can be maintained during movement thereof. Accordingly, no extra moments are produced around the center of gravity of the car, thereby it is possible to practically provide an elevator which causes extremely slight oscillation and which provides a very comfortable ride.

Further, it is possible to save the installation space of the sheave section of the elevator Since many changes and variations of the disclosed embodiment of the invention may be made without departing from the inventive concept, it is not intended to limit the invention otherwise than as required by the appended claims.

What is claimed is:

1. A sheave array for use in an elevator system for guiding counterweight and car ropes, said array comprising: a first sheave pair having parallel axes of rotation, one sheave of said first sheave pair guiding ropes attached to a first side portion of the counterweight, and the other sheave of said first sheave pair guiding ropes attached to said car in the vicinity of a vertical line passing through the center of gravity of the car; and a second sheave pair having parallel axes of rotation, the axes of rotation of said second sheave pair being skew to the axes of rotation of said first sheave pair, one sheave of said second sheave pair guiding ropes attached to a side portion of the counterweight opposite said first side portion, and the other sheave of said second sheave pair guiding ropes attached to the car in the vicinity of said vertical line.

2. The sheave of claim 1 wherein said first and second sheave pairs are mirror images of each other when viewed in plan.

3. The sheave array of claim 1 wherein the ropes on each sheave pair converge toward each other on the car side of said sheave array and diverge away from each other on the counterweight side of said sheave array when viewed in plan.

* * * * *